US007679485B2

(12) United States Patent
Kishimoto et al.

(10) Patent No.: US 7,679,485 B2
(45) Date of Patent: Mar. 16, 2010

(54) MULTILAYER POSITIVE TEMPERATURE COEFFICIENT THERMISTOR

(75) Inventors: Atsushi Kishimoto, Kusatsu (JP); Kenjirou Mihara, Higashiomi (JP); Hideaki Niimi, Hikone (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 12/050,413

(22) Filed: Mar. 18, 2008

(65) Prior Publication Data

US 2008/0204187 A1 Aug. 28, 2008

Related U.S. Application Data

(63) Continuation of application No. PCT/JP2006/318630, filed on Sep. 20, 2006.

(30) Foreign Application Priority Data

Sep. 20, 2005 (JP) ..... 2005-272484

(51) Int. Cl.
*H01C 7/10* (2006.01)

(52) U.S. Cl. ..... 338/22 R; 338/307; 338/328; 361/308.1; 361/309

(58) Field of Classification Search ..... 338/22 R, 338/13, 260, 307–309, 328; 361/308.1, 306.1, 361/306.3, 309, 310
See application file for complete search history.

(56) References Cited

U.S. PATENT DOCUMENTS 6,911,102 B2 * 6/2005 Niimi ..... 156/89.14
7,295,421 B2 * 11/2007 Mihara et al. ..... 361/308.1

FOREIGN PATENT DOCUMENTS

| | | |
|---|---|---|
| JP | 06-302403 | 10/1994 |
| JP | 07-014702 | 1/1995 |
| JP | 2001-031471 | 2/2001 |
| JP | 2001-052904 | 2/2001 |
| JP | 2001-130957 | 5/2001 |
| JP | 2001-167906 | 6/2001 |
| JP | 2001-203102 | 7/2001 |
| JP | 2004-063548 | 2/2004 |
| JP | 2004-134744 | 4/2004 |
| JP | 2005-096574 | 4/2005 |
| WO | WO 2004/075216 | 9/2004 |
| WO | WO 2007/034830 | 3/2007 |

OTHER PUBLICATIONS

Written Opinion for PCT/JP2006/318630 dated Dec. 26, 2006.
Search Report for PCT/JP2006/318630 dated Dec. 26, 2006.

* cited by examiner

*Primary Examiner*—Kyung Lee
(74) *Attorney, Agent, or Firm*—Dickstein Shapiro LLP

(57) ABSTRACT

A multilayer positive temperature coefficient thermistor that has semiconductor ceramic layers containing a $BaTiO_3$-based ceramic material as a primary component, and at least one element selected from the group consisting of Eu, Gd, Tb, Dy, Y, Ho, Er, and Tm as a semiconductor dopant in the range of 0.1 to 0.5 molar parts with respect to 100 molar parts of Ti. The ratio of the Ba site to the Ti site is in the range of 0.998 to 1.006. Accordingly, even when the semiconductor ceramic layers have a low actual-measured sintered density in the range of 65% to 90% of a theoretical sintered density, a multilayer positive temperature coefficient thermistor having a sufficiently high rate of resistance change and a high rising coefficient of resistance at the Curie temperature or more can be realized.

9 Claims, 1 Drawing Sheet

MULTILAYER POSITIVE TEMPERATURE COEFFICIENT THERMISTOR

CROSS REFERENCE TO RELATED APPLICATIONS

The present application is a continuation of International Application No. PCT/JP2006/318630, filed Sep. 20, 2006, which claims priority to Japanese Patent Application No. JP2005-272484, filed Sep. 20, 2005, the entire contents of each of these applications being incorporated herein by reference in their entirety.

FIELD OF THE INVENTION

The present invention relates to a multilayer positive temperature coefficient thermistor used for overcurrent protection, temperature detection, and the like, and more particularly relates to a multilayer positive temperature coefficient thermistor which has a high rate of resistance change and which improves a rising coefficient of resistance at the Curie temperature or more.

BACKGROUND OF THE INVENTION

In recent years, the sizes of electronic devices have been progressively decreased, and concomitant therewith, the decreasing in size of positive temperature coefficient thermistors mounted in the above-mentioned electronic devices has also been implemented. The positive temperature coefficient thermistor described above has a positive resistance temperature characteristic, and as a decreased in size positive temperature coefficient thermistor, for example, a multilayer positive temperature coefficient thermistor is known.

This type multilayer positive temperature coefficient thermistor described above generally has a ceramic body which includes a plurality of semiconductor ceramic layers each having a positive resistance temperature characteristic and a plurality of internal electrode layers formed along interfaces between the semiconductor ceramic layers, the internal electrode layers are alternately extended to two end portions of the ceramic body, and external electrodes are also formed so as to be electrically connected to the internal electrode layers thus extended. In addition, as the semiconductor ceramic layer, a material primarily containing a $BaTiO_3$-based ceramic material is used. Furthermore, in order to obtain a positive resistance temperature characteristic by a $BaTiO_3$-based ceramic material, an extremely small amount of a semiconductor dopant is added thereto, and as this semiconductor dopant, in general, samarium (Sm) has been widely used.

In addition, as an internal electrode material used in the multilayer positive temperature coefficient thermistor, Ni has been widely used. In general, the ceramic body of the multilayer positive temperature coefficient thermistor is formed by the steps of performing screen printing of an internal electrode conductive paste on ceramic green sheets to be formed into the semiconductor ceramic layers to form conductive patterns, laminating the ceramic green sheets provided with the conductive patterns in a predetermined order, and simultaneously firing the ceramic green sheets and the conductive patterns.

Moreover, when Ni is used as the internal electrode material, the simultaneous firing must be performed in a reducing atmosphere since Ni is oxidized when simultaneous firing is performed in an air atmosphere, However, when the simultaneous firing is performed in a reducing atmosphere, the semiconductor ceramic layers are also reduced, and as a result, a sufficient rate of resistance change cannot be obtained. Accordingly, in general, after the simultaneous firing is performed in a reducing atmosphere, a re-oxidation treatment is additionally performed in an air atmosphere or in an oxygen atmosphere.

However, in this re-oxidation treatment, a heat treatment temperature is difficult to control, and it is not easy to diffuse oxygen sufficiently to a central portion of the ceramic body; hence, oxidation is irregularly performed thereby, and as a result, a sufficient rate of resistance change may not be obtained in some cases.

Accordingly, in Patent Document 1, a multilayer positive temperature coefficient thermistor has been proposed in which a void ratio of semiconductor ceramic layers is set in the range of 5 to 40 percent by volume, and among thermistor layers, which are effective layers provided between two internal electrodes located at the outermost sides in the lamination direction, the void ratio of a thermistor layer located at a central portion in the lamination direction is higher than that of a thermistor layer located outside in the lamination direction.

According to the Patent Document 1, although the void ratio of the semiconductor ceramic layers are set in the range of 5 to 40 percent by volume, when this void ratio is converted into a sintered density, the sintered density thus converted approximately corresponds to 60% to 95% of a theoretical sintered density. In addition, according to this Patent Document 1, an actual-measured sintered density of the semiconductor ceramic layers is decreased to 60% to 95% of the theoretical sintered density, and the void ratio of the thermistor layer located at the central portion is increased larger than that of the thermistor layer located outside, so that oxygen can be easily diffused sufficiently to the central portion of the ceramic body; hence, as a result, by preventing the generation of irregular oxidation, it is intended to obtain a desired rate of resistance change.

Patent Document 1: Japanese Unexamined Patent Application Publication No. 2005-93574

However, as described in the Patent Document 1, when the semiconductor ceramic layers including a $BaTiO_3$-based ceramic material as a primary component and Sm as a semiconductor dopant added thereto and the internal electrode layers using Ni as an electrode material are formed by simultaneous firing so as to obtain, for example, semiconductor ceramic layers having an actual-measured sintered density in the range of 65% to 90% of the theoretic sintered density, there has been a problem in that a rising coefficient of resistance is low at the Curie temperature or more.

That is, when a semiconductor ceramic layer having a low sintered density is formed in order to obtain a high rate of resistance change, the rising coefficient of resistance is decreased, and as a result, a high rate of resistance change and a high rising coefficient of resistance could not be achieved at the same time.

SUMMARY OF THE INVENTION

The present invention has been conceived in consideration of the above situation, and an object of the present invention is to provide, even when semiconductor ceramic layers primarily composed of a $BaTiO_3$-based material and having a low sintered density are used, a multilayer positive temperature coefficient thermistor which has a high rate of resistance change and also has a high rising coefficient of resistance at the Curie temperature or more.

In order to achieve the above object, the inventors of the present invention carried out intensive research. As a result, it was found that even if the semiconductor ceramic layers contain a $BaTiO_3$-based ceramic material as a primary component and also have a low actual-measured sintered density which is in the range of 65% to 90% of the theoretical sintered density, when the ratio of the Ba site to the Ti site is set in the range of 0.998 to 1.006, and 0.1 to 0.5 molar parts of a specific substance, such as Dy or Y, is added as a semiconductor dopant with respect to 100 molar parts of Ti, a high rising coefficient of resistance can be maintained even when a firing treatment is performed at a high firing temperature, and as a result, a multilayer positive temperature coefficient thermistor which can simultaneously achieve a high rate of resistance change and a high rising coefficient of resistance can be obtained.

The present invention has been conceived based on the insight described above, and a multilayer positive temperature coefficient thermistor of the present invention comprises: a ceramic body in which semiconductor ceramic layers having an actual-measured sintered density in the range of 65% to 90% of a theoretical sintered density and internal electrode layers are alternately laminated to each other and are sintered; and external electrodes formed on two end portions of the ceramic body so as to be electrically connected to the internal electrode layers. According to this multilayer positive temperature coefficient thermistor, in the semiconductor ceramic layers, a $BaTiO_3$-based ceramic material is contained as a primary component, the ratio of the Ba site to the Ti site of the $BaTiO_3$-based ceramic material is represented by $0.998 \leqq$ Ba site/Ti site $\leqq 1.006$, and at least one element selected from the group consisting of Eu, Gd, Tb, Dy, Y, Ho, Er, and Tm is contained as a semiconductor dopant in the range of 0.1 to 0.5 molar parts with respect to 100 molar parts of Ti.

In addition, in this type of multilayer positive temperature coefficient thermistor, as an internal electrode material, a conductive material containing Ni as a primary material is generally used, and it has been known that when internal electrode layers and semiconductor ceramic layers are formed by simultaneous firing, the conductive material primarily containing Ni is diffused from the internal electrode layers into the semiconductor ceramic layers to form diffusion layers along the interfaces between the internal electrode layers and the semiconductor ceramic layers. As a result, in order to ensure various properties, such as a rising coefficient of resistance and the rate of resistance change, of a multilayer positive temperature coefficient thermistor, the thickness of the semiconductor ceramic layers had to be inevitably increased in the past.

However, according to the research results obtained by the inventors of the present invention, it was found that when the ratio of the Ba site to the Ti site is set in the range described above, and when the above specific semiconductor dopant in the above range is contained in the semiconductor ceramic layer, the thickness of the diffusion layer can be reduced, and as a result, the thickness of the semiconductor ceramic layer, which actually contributes to properties of the multilayer positive temperature coefficient thermistor, can be reduced.

In particular, it was found that even when the ratio of a thickness t of the diffusion layer to a thickness D of the semiconductor ceramic layer is set in the range of 0.01 to 0.20, a multilayer positive temperature coefficient thermistor having superior rate of resistance change and rising coefficient of resistance can be obtained.

That is, according to the multilayer positive temperature coefficient thermistor of the present invention, the internal electrode layers primarily contains Ni, the semiconductor ceramic layers and the internal electrode layers are formed by simultaneous firing, and the ratio of the thickness t of the diffusion layers to the thickness D of the semiconductor ceramic layers is represented by $0.01 \leqq t/D \leqq 0.20$, the diffusion layers being primarily formed of Ni which is diffused from the internal electrode layers into the semiconductor ceramic layers during the simultaneous firing.

According to the multilayer positive temperature coefficient thermistor of the present invention, in the semiconductor ceramic layers, a $BaTiO_3$-based ceramic material is contained as a primary component, the ratio of the Ba site to the Ti site is represented by $0.998 \leqq$ Ba site/Ti site $\leqq 1.006$, and at least one element selected from the group consisting of Eu, Gd, Tb, Dy, Y, Ho, Er, and Tm is contained as a semiconductor dopant in the range of 0.1 to 0.5 molar parts with respect to 100 molar parts of Ti. Hence, even if the actual-measured sintered density of the semiconductor ceramic layers is low in the range of 65% to 90% of the theoretical sintered density, the rising coefficient of resistance can be made steep at the Curie temperature or more, and in addition, even when firing is performed at a high firing temperature, a sufficient rate of resistance change can be obtained, so that superior rate of resistance change and rising coefficient of resistance can be simultaneously obtained.

In addition, the internal electrode layers primarily include Ni, the semiconductor ceramic layers and the internal electrode layers are formed by simultaneous firing, and the ratio of the thickness t of the diffusion layers, which primarily include Ni diffused from the internal electrode layers into the semiconductor ceramic layers during the above simultaneous firing, to the thickness D of the semiconductor ceramic layers is represented by $0.01 \leqq t/D \leqq 0.20$. Hence, even when the thickness of the semiconductor ceramic layers is small, a multilayer positive temperature coefficient thermistor can be obtained which simultaneously has superior rising coefficient of resistance and rate of resistance change, the thickness of the semiconductor ceramic layers can be even further reduced, and as a result, the size of the multilayer positive temperature coefficient thermistor can be decreased.

REFERENCE NUMERALS

2 semiconductor ceramic layer
3*a*, 3*b* internal electrode layer
4 ceramic body
5*a*, 5*b* external electrode

DETAILED DESCRIPTION OF THE INVENTION

Next, an embodiment of the present invention will be described in detail.

Figure 1:
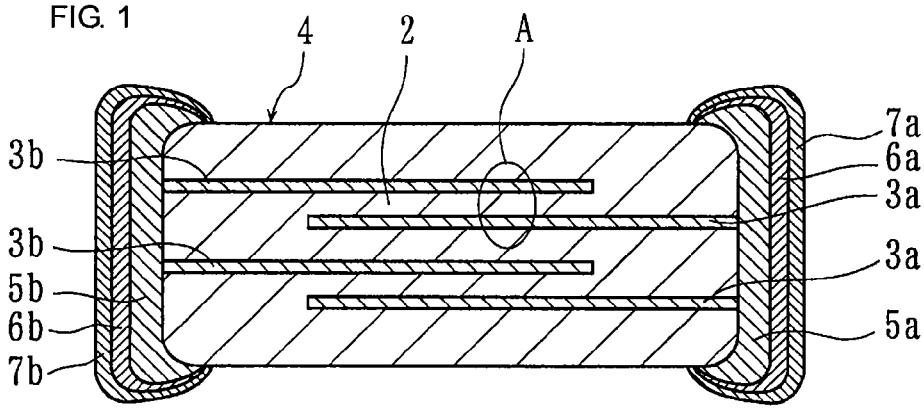
FIG. 1 is a schematic cross-sectional view schematically showing one embodiment of a multilayer positive temperature coefficient thermistor according to the present invention.

FIG. 1 is a schematic cross-sectional view showing one embodiment of a multilayer positive temperature coefficient thermistor of the present invention.

In this multilayer positive temperature coefficient thermistor, internal electrode layers 3*a* and 3*b* are embedded in a ceramic body 4 having semiconductor ceramic layers 2. In addition, external electrodes 5*a* and 5*b* are formed on two end portions of the ceramic body 4 so as to be electrically connected to the internal electrode layers 3*a* and 3*b*. That is, the internal electrode layers 3*a* and the internal electrode layers 3*b* are formed so as to be alternately extended to one end surface of the ceramic body 4 and the other end surface thereof. Furthermore, the external electrode 5*a* is electrically connected to the internal electrode layers 3*a*, and the external electrode 5*b* is electrically connected to the internal electrode layers 3*b*.

In addition, first plating films 6*a* and 6*b* composed of Ni or the like are formed on the surfaces of the external electrodes 5*a* and 5*b*, and second plating films 7*a* and 7*b* composed of Sn or the like are further formed on the surfaces of the first plating films 6*a* and 6*b*.

In addition, the semiconductor ceramic layers 2 are formed so as to have an actual-measured sintered density in the range of 65% to 90% of a theoretical sintered density.

That is, when the actual-measured sintered density is less than 65% of the theoretical sintered density, since the sintered density is excessively decreased, the mechanical strength of the ceramic body 4 is decreased, and/or the room-temperature resistance thereof is increased. On the other hand, when the actual-measured sintered density is more than 90% of the theoretical sintered density, since the sintered density is excessively high, it becomes difficult to diffuse oxygen sufficiently to a central portion of the ceramic body 4 during a re-oxidation treatment, and the re-oxidation treatment is not smoothly performed; hence, as a result, a sufficient rate of resistance change cannot be obtained.

On the other hand, when the actual-measured sintered density of the semiconductor ceramic layer 2 is in the range of 65% to 90% of the theoretical sintered density, without causing degradation in mechanical strength, oxygen can be sufficiently diffused to the central portion of the ceramic body 4 during the re-oxidation treatment, and as a result, a multilayer positive temperature coefficient thermistor having a sufficient rate of resistance change can be obtained. Furthermore, an improvement in rising coefficient of resistance at the Curie temperature or more can be achieved.

In the semiconductor ceramic layer 2, from a texture point of view, a $BaTiO_3$-based ceramic material having a perovskite structure (general formula: $ABO_3$) is contained as a primary component, the ratio (=Ba site/Ti site) of the Ba site to the Ti site is set in the range of 0.998 to 1.006, and as a semiconductor dopant, at least one element selected from the group consisting of Eu, Gd, Tb, Dy, Y, Ho, Er, and Tm (hereinafter, these semiconductor dopants are collectively referred to as the "specific semiconductor dopant") is contained in the range of 0.1 to 0.5 molar parts with respect to 100 molar parts of Ti.

Accordingly, a sufficient rate of resistance change can be obtained, and in addition, the rising coefficient of resistance can also be increased; hence, superior rate of resistance change and rising coefficient of resistance can be simultaneously obtained.

In $BaTiO_3$ represented by the general formula $ABO_3$, the Ba site indicates the entire A sites at which Ba atoms are coordinated, and hence, when atoms replacing some of the Ba atoms are coordinated at A sites, the sites at which the replacing atoms are coordinated are also included in the Ba site. In the same manner as described above, the Ti site indicates the entire B sites at which Ti atoms are coordinated, and hence, when atoms replacing some of the Ti atoms are coordinated at B sites, the sites at which the replacing atoms are coordinated are also included in the Ti site.

In addition, the reasons the ratio (=Ba site/Ti site) of the Ba site to the Ti site is set in the range of 0.998 to 1.006 are described below.

Although a predetermined amount of the specific semiconductor dopant is contained in the semiconductor ceramic layer, when the Ba site/Ti site is less than 0.998, the rising coefficient of resistance is decreased, the rate of resistance change is decreased, and further the room-temperature resistance is increased. On the other hand, also when the Ba site/Ti site is more than 1.006, the room-temperature resistance is increased, and in addition, both the rising coefficient of resistance and the rate of resistance change become unstable.

Accordingly, in this embodiment, the amounts of the individual components are adjusted so that the ratio (Ba site/Ti site) of the Ba site to the Ti site is in the range of 0.998 to 1.006.

In addition, the reasons the specific semiconductor dopant is contained in the range of 0.1 to 0.5 molar parts with respect to 100 molar parts of Ti are described below.

When Sm is used as the semiconductor dopant as described in the Patent Document 1, in order to decrease the sintered density of the semiconductor ceramic layer 2, firing must be performed at a low temperature of approximately 1,200° C., and as a result, it has been difficult to obtain a high rising coefficient of resistance.

However, according to the research results obtained by the inventors of the present invention, it was found that when the above specific semiconductor dopant is selected and is added to the primary component, firing can be performed at a higher temperature (such as 1,200 to 1,300° C.), and the rising coefficient of resistance is improved.

On the other hand, since the sintered density is increased when the firing temperature is increased, it may be probably difficult to improve the rate of resistance change.

However, through intensive research carried out by the inventors of the present invention, it was found that when the specific semiconductor dopant is added to the primary component, even if the firing temperature is increased, the actual-measured sintered density can be maintained at a low level of approximately 65% to 90% of the theoretical sintered density, and as a result, a sufficient high rate of resistance change can be obtained. That is, by addition of the above specific semiconductor dopant to the primary component, a high rate of resistance change and an improvement in rising coefficient of resistance can be simultaneously obtained.

However, when the content of the specific semiconductor dopant is less than 0.1 molar parts with respect to 100 molar parts of Ti, the $BaTiO_3$-based ceramic material cannot be sufficiently semiconductorized, and as a result, the room-temperature resistance is increased. On the other hand, when the content of the specific semiconductor dopant is more than 0.5 molar parts with respect to 100 molar parts of Ti, the room-temperature is also increased, and further in this case, the rate of resistance change and the rising coefficient of resistance are both decreased.

Accordingly, in this embodiment, the content of the specific semiconductor dopant is adjusted in the range of 0.1 to 0.5 molar parts with respect to 100 molar parts of Ti.

In addition, as an internal electrode material forming the internal electrode layers 3*a* and 3*b*, a material having superior ohmic contact with the semiconductor ceramic layer 2 is preferable, and although a material containing Ni as a primary component, such as a Ni element or a Ni alloy, may be used, a material containing another metal, such as Cu, may also be used as long as it contains Ni as a primary component.

Figure 2:
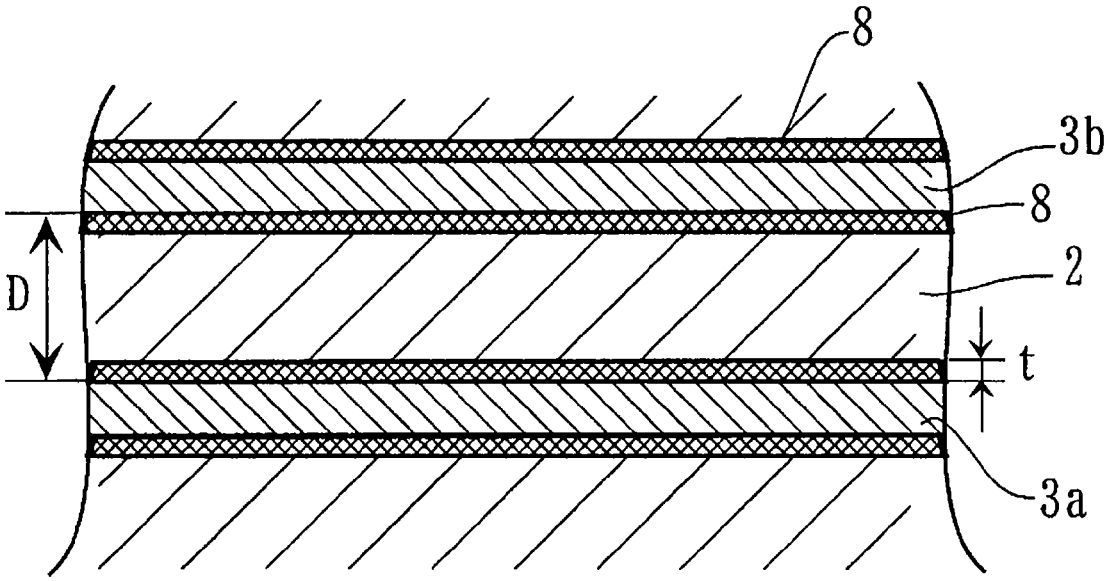
FIG. 2 is an enlarged view of the a portion A in FIG. 1.

Incidentally, in the multilayer positive temperature coefficient thermistor, when the internal electrode layers 3*a* and 3*b* and the semiconductor ceramic layers 2 are formed by simultaneous firing, as shown in FIG. 2, Ni, which is the primary component of the internal electrode layers 3*a* and 3*b*, is diffused into the semiconductor ceramic layer 2, and diffusion layers 8 are formed between the semiconductor ceramic layer 2 and the internal electrode layers 3*a* and 3*b*.

In addition, in this embodiment, even when a thickness D of the semiconductor ceramic layer 2 is decreased so that a ratio t/D of a thickness t of the diffusion layer 8 to a thickness D of the semiconductor ceramic layer is set such that $0.01 \leqq t/D \leqq 0.20$ holds, a multilayer positive temperature coefficient thermistor having a superior rising coefficient of resistance and a high rate of resistance change can be obtained.

That is, in general, when Ni is diffused into the semiconductor ceramic layer 2 during a firing treatment, this Ni functions as an acceptor for a $BaTiO_3$-based ceramic material. When the content of a semiconductor dopant functioning as a donor for the $BaTiO_3$-based ceramic material is excessive, or when a specific type of semiconductor dopant is used, since the donor effect is counteracted, the diffusion of Ni, which functions as an acceptor, from the internal electrode layers 3*a* and 3*b* tends to be promoted. As a result, the diffusion layer 8 having a relatively large thickness is liable to be formed; hence, the rising coefficient of resistance is decreased, and in addition, the rate of resistance change may also be decreased. Accordingly, in order to improve the rising coefficient of resistance and the rate of resistance change, the thickness D of the semiconductor ceramic layer 2 must be inevitably increased.

However, as the case of this embodiment, when $BaTiO_3$ is used as a primary component, the ratio of the B site to the Ti site is set in the range of 0.998 to 1.006, and the specific semiconductor dopant in a predetermined amount is added to the primary component, since the specific semiconductor dopant is solid-solved in both the Ba site and the Ti site, Ni functioning as an acceptor can be prevented as much as possible from being solid-solved in the Ti site. Hence, as a result, the diffusion of Ni itself from the internal electrode layers 3*a* and 3*b* can be suppressed, and the thickness D of the semiconductor ceramic layer 2 can be reduced thereby.

In addition, according to the research results obtained by the inventors of the present invention, even when the thickness D of the semiconductor ceramic layer 2 is decreased so that the ratio t/D of the thickness t of the diffusion layer 8 to the thickness D of the semiconductor ceramic layer 2 is in the range of 0.01 to 0.20, a multilayer positive temperature coefficient thermistor having a superior rising coefficient of resistance and a high rate of resistance change can be obtained, and as a result, a multilayer positive temperature coefficient thermistor having an even further reduced thickness and size can be realized.

The reasons the ratio t/D is set in the range of 0.01 to 0.20 are described below.

When the ratio t/D is more than 0.20, the thickness D of the semiconductor ceramic layer 2 is small as compared to the thickness t of the diffusion layer 8, and as a result, a large amount of Ni is diffused into the semiconductor ceramic layer 2; hence, the rising coefficient of resistance is decreased, and in addition, a sufficient rate of resistance change cannot be obtained. On the other hand, when the ratio t/D is less than 0.01, since delamination is generated between the semiconductor ceramic layer 2 and the internal electrode layers 3*a* and 3*b*, the room-temperature resistance may be increased, and/or the rate of resistance change may vary; hence, it is not preferable.

Accordingly, the ratio t/D is preferably set in the range of 0.01 to 0.20.

In addition, as an external electrode material forming the external electrodes 5*a* and 5*b*, a noble metal element and an alloy thereof, such as Ag, Ag—Pd, and Pd, or a base metal element, such as Ni and Cu, and an alloy thereof may be used, and a material having suitable connection to and conduction with the internal electrode layers 3*a* and 3*b* is preferably selected.

The thickness of the semiconductor ceramic layer 2 can be variously adjusted in accordance with a required room-temperature resistance and the number of layers to be laminated, and a thickness in the range of approximately 5 to 50 μm may be used; however, in this embodiment, since the thickness of the diffusion layer 8 can be decreased, even when the thickness is in the range of 5 to 20 μm, a sufficient effect can be obtained.

As described above, in this multilayer positive temperature coefficient thermistor, since (i) the ratio of the Ba site to the Ti site is set in the range of 0.998 to 1.006, and (ii) the specific semiconductor dopant (at least one of the group of Eu, Gd, Tb, Dy, Y, Ho, Er, and Tm) in the range of 0.1 to 0.5 molar parts with respect to 100 molar parts of Ti is contained in the semiconductor ceramic layer 2, even when the actual-measured sintered density of the semiconductor ceramic layer 2 is low in the range of 65% to 90% of the theoretical sintered density, a multilayer positive temperature coefficient thermistor having a high rising coefficient of resistance as well as a sufficient rate of resistance change can be obtained.

Furthermore, even when the ratio t/D of the thickness t of the diffusion layer 8 to the thickness D of the semiconductor ceramic layer 2 satisfies $0.01 \leqq t/D \leqq 0.20$, a multilayer positive temperature coefficient thermistor having high rising coefficient of resistance α and rate of resistance change can be obtained, and hence a multilayer positive temperature coefficient thermistor having an even further small size can be obtained.

Next, a method for manufacturing the above multilayer positive temperature coefficient thermistor will be described.

First, as starting materials, $BaCO_3$ and $TiO_2$ are prepared, and in addition, at least one of $Eu_2O_3$, $Gd_2O_3$, $Tb_4O_7$, $Dy_2O_3$, $Y_2O_3$, $Ho_2O_3$, $Er_2O_3$, and $Tm_2O_3$ is also prepared.

Subsequently, the above starting materials in predetermined amounts are weighed so as to obtain a ceramic composition represented by $(Ba_{1-p}A_p)\times(Ti_{1-q}A_q)_yO_3$ (where A indicates at least one of Eu, Gd, Tb, Dy, Y, Ho, Er, and Tm, and $px+qy=u$, $0.998 \leqq x/y \leqq 1.006$, and $0.00 \leqq u \leqq 0.005$ hold). Next, after the materials thus weighed are charged in a ball mill together with a pulverizing medium, such as partially stabilized zirconia (hereinafter referred to as "PSZ balls"), and are sufficiently processed by wet mixing and pulverizing, calcination is performed at a predetermined temperature (such as 1,000 to 1,200° C.), so that a ceramic powder is formed.

Next, an organic binder is added to the above ceramic powder, followed by performing a wet mixing treatment, so that a ceramic slurry is formed. Subsequently, the ceramic slurry thus obtained is formed into sheets by a sheet forming method, such as a doctor blade method, thereby forming ceramic green sheets.

In this step, the addition amount of the organic binder is adjusted so that the actual-measured sintered density of the semiconductor ceramic layer 2 after firing is in the range of 65% to 90% of the theoretical sintered density. In addition, the thickness of the ceramic green sheet is preferably adjusted so that the ratio t/D of the thickness t of the diffusion layer 8 to the thickness D of the semiconductor ceramic layer 2 after firing is in the range of 0.01 to 0.2.

Subsequently, an internal electrode conductive paste containing Ni as a primary component is prepared. Next, this internal electrode conductive paste is applied by screen printing or the like on the above ceramic green sheets, thereby forming conductive patterns.

Next, after the ceramic green sheets provided with the conductive patterns are laminated in a predetermined order, ceramic green sheets which are not provided with the conductive patterns are disposed at the top and the bottom, followed by pressure-bonding, so that a laminate is formed.

Subsequently, after this laminate is cut into a predetermined size and is then received in an alumina-made sagger, a de-binding treatment is performed at a predetermined temperature (such as 300 to 400° C.). Next, a firing treatment is performed in a predetermined reducing atmosphere (for example, the concentration of a $H_2$ gas to that of a $N_2$ gas is approximately 1 to 3 percent by weight) and at a predetermined temperature (such as 1,200 to 1,250° C.), and as a result, the ceramic body 4 is formed in which the internal electrode layers 3*a* and 3*b* and the semiconductor ceramic layers 2 are alternately laminated to each other.

Subsequently, the ceramic body 4 described above is processed by a re-oxidation treatment in an air atmosphere or an oxygen atmosphere at a predetermined temperature (such as 500 to 700° C.).

Next, a sputtering treatment is performed on the two end portions of the ceramic body 4, so that the external electrodes 5*a* and 5*b* primarily composed of Ag are formed. Furthermore, on the surfaces of the external electrodes 5*a* and 5*b*, the Ni films 6*a* and 6*b* and the Sn films 7*a* and 7*b* are sequentially formed by an electroplating method, so that the multilayer positive temperature coefficient thermistor described above is manufactured.

Incidentally, the present invention is not limited to the above embodiment. In the above embodiment, the sintered density of the semiconductor ceramic layer 2 is adjusted by the addition amount of the organic binder when the ceramic green sheets are formed; however, the adjustment is not limited thereto.

In addition, in the above embodiment, as a method for forming the external electrodes 5*a* and 5*b*, although a sputtering method is used, a baking treatment may also be used. That is, after an external electrode conductive paste is applied to the two end portions of the ceramic body 4, baking may be performed at a predetermined temperature (such as 550 to 700° C.), and in this step, this baking may also be performed as a re-oxidation treatment for the ceramic body 4. In addition, besides a sputtering method, another thin-film forming method, such as a vacuum deposition method, may also be used as long as it gives superior adhesion.

In addition, in the above embodiment, although the oxides are used as the starting materials, carbonates or the like may also be used.

In addition, although the multilayer positive temperature coefficient thermistor of the present invention is effectively used for overcurrent protection and temperature detection, the present invention is not only limited thereto. In the multilayer positive temperature coefficient thermistor shown in FIG. 1, the internal electrode layers 3*a* and 3*b* are alternately connected to the external electrodes 5*a* and 5*b*; however, when there is provided at least one set including the internal electrode layers 3*a* and 3*b* which are adjacent to each other with the semiconductor ceramic layer 2 interposed therebetween and which are connected to the external electrodes 5*a* and 5*b* connected to different potentials, other internal electrode layers 3*a* and 3*b* may not always be alternately formed; hence, the present invention in not limited to a multilayer positive temperature coefficient thermistor having the structure shown in FIG. 1.

In addition, among the surfaces of the ceramic body 4, a protective layer, such as a glass layer or a resin layer, (not shown) may be formed on a surface on which the external electrodes 5*a* and 5*b* are not formed, and when the protective layer as described above is formed, the multilayer positive temperature coefficient thermistor is even more reliably protected from the outside environment, so that the degradation in properties caused, for example, by temperature and/or humidity can be suppressed.

Next, examples of the present invention will be described in detail.

Example 1

First, as starting materials, $BaCO_3$, $TiO_2$, $Eu_2O_3$, $Gd_2O_3$, $Tb_4O_7$, $Dy_2O_3$, $Y_2O_3$, $Ho_2O_3$, $Er_2O_3$, and $Tm_2O_3$ were prepared, and these starting materials were weighed so as to obtain a semiconductor ceramic layer having a composition of $(Ba_{0.998}A_{0.002-\nu})(TiA_\nu)O_3$ (where A indicated Eu, Gd, Tb, Dy, Y, Ho, Er, or Tm).

Subsequently, after pure water was added to these starting materials, mixing and pulverizing were performed in a ball mill together with PSZ balls, followed by drying. Next, calcination was performed at 1,150° C. for 2 hours, and pulverizing was again performed in a ball mill with PSZ balls, so that a calcined powder was obtained.

Next, after an acrylic acid-based organic binder, an ammonium polycarboxylate salt used as a dispersant, and pure water were added to the calcined powder thus obtained, mixing was performed in a ball mill together with PSZ balls for 15 hours, so that a ceramic slurry was obtained. In this step, the addition amount of the acrylic acid-based binder was adjusted so that the actual-measured sintered density after firing was 70% of the theoretical sintered density.

Subsequently, the ceramic slurry thus obtained was formed into sheets by a doctor blade method, followed by drying, thereby forming ceramic green sheets so that semiconductor ceramic layers after firing had a thickness of 20 μm.

Next, a Ni powder and an organic binder were dispersed in an organic solvent to form an internal electrode conductive paste. Then, the internal electrode conductive paste thus obtained was applied by screen printing on a primary surface of the ceramic green sheet so that the thickness of an internal electrode layer after firing was 1 μm, thereby forming a conductive pattern.

Subsequently, after 25 ceramic green sheets provided with the conductive patterns were laminated to each other so that the conductive patterns faced each other with the respective ceramic green sheets interposed therebetween, two sets each including 5 protective ceramic green sheets provided with no conductive patterns were further disposed on the top and the bottom of the above laminate, and cutting was then performed, so that a green laminate having a length of 2.2 mm, a width of 1.3 mm, and a thickness of 0.9 mm was formed. After this green laminate was processed by a de-binding treatment in an air atmosphere at 400° C. for 12 hours, firing was performed for 2 hours in a reducing atmosphere in which the concentration of a $H_2$ gas to that of a $N_2$ gas was adjusted to 3 percent by weight at a firing temperature of 1,150° C., 1,200° C., 1,225° C., 1,250° C., or 1,275° C., so that a ceramic body composed of the semiconductor ceramic layers and the internal electrode layers were alternately laminated to each other was obtained.

Next, after the surface of the ceramic body thus obtained was processed by barrel polishing, the ceramic body was immersed in a silica-based glass solution, followed by drying at a temperature of 600° C. Subsequently, a re-oxidation treatment was performed at a temperature of 700° C. in an air atmosphere so that a glass protective layer was formed on the surface of the ceramic body. Next, after barrel polishing was performed on external electrode forming portions of the ceramic body provided with the glass protective layer, a sputtering treatment was sequentially performed on the two end portions of the ceramic body using Cu, Cr, and Ag as a target, thereby forming external electrodes each having a three-layer structure.

Finally, electroplating was performed on the surfaces of the external electrodes to sequentially form a Ni film and a Sn film on the surface of each external electrode, so that multilayer positive temperature coefficient thermistors of Sample Nos. 1 to 8 were formed.

In addition, as the semiconductor dopant, $Sm_2O_3$, $Yb_2O_3$, and $Lu_2O_3$ were used, and samples of Sample Nos. 9 to 11 were formed as comparative examples by a method and a procedure similar to those described above.

In this example, as described above, the addition amount of the acrylic acid-based organic binder was adjusted so that the actual-measured sintered density was 70% of the theoretical sintered density, and this actual-measured sintered density was obtained as described below. That is, first, ceramic green sheets provided with no conductive patterns were laminated and were then processed by a firing treatment so as to additionally form a sample used for measurement of the sintered density, and the actual-measured sintered density was calculated by measuring the volume and the weight of this sample.

Next, after 20 samples of each of Sample Nos. 1 to 11 were prepared, by applying a voltage of 0.01 V, the temperature was increased from 20 to 250° C. by 10° C., and the resistance was measured by a direct current four terminal method every time when the temperature was increased by 10° C.

Next, based on the obtained resistance, a room-temperature resistance X (Ω), a rate ΔR of resistance change (number of digit), and a rising coefficient of resistance α (%/° C.) at the Curie temperature or more were obtained from the following equations (1) to (3).

$$X=(R_{20}+R_{30})/2 \quad (1)$$

$$\Delta R=\log(R_{250}/R_{25}) \quad (2)$$

$$\alpha=\{2.303\log(R_{150}/R_{130})/(150-130)\times 100 \quad (3)$$

Since the Curie temperature of $BaTiO_3$ was 125° C., the rising coefficient of resistance a at the Curie temperature or more was calculated from 130 to 150° C.

Table 1 shows the average values, which were obtained from 20 samples of each of Samples 1 to 11, of the sintered density (relative ratio of the actual-measured sintered density to the theoretical sintered density), the optimum firing temperature, the room-temperature resistance X, the rate ΔR of resistance change, and the rising coefficient of resistance (hereinafter simply referred to as the "rising coefficient") α at the Curie temperature or more.

The optimum firing temperature indicates the lowest temperature among firing temperatures at which the room-temperature resistance X is 0.3Ω or less, the number of digits of the rate of resistance change is 3.5 or more, and the sintered density is 70%.

TABLE 1

| | $(Ba_{0.998}A_{0.002-y})(TiA_y)O_3$ | | | | | |
|---|---|---|---|---|---|---|
| Sample No. | A | Sintered Density (%) | Optimum Firing Temperature (° C.) | Room-Temperature Resistance X (Ω) | Rate ΔR of Resistance change (Number of Digits) | Rising coefficient α (%/° C.) |
| 1 | Eu | 70 | 1225 | 0.2 | 4.2 | 9 |
| 2 | Gd | 70 | 1225 | 0.2 | 4.5 | 9 |
| 3 | Tb | 70 | 1225 | 0.2 | 4.4 | 10 |
| 4 | Dy | 70 | 1225 | 0.2 | 4.5 | 10 |
| 5 | Y | 70 | 1250 | 0.22 | 4.5 | 12 |
| 6 | Ho | 70 | 1250 | 0.22 | 4.3 | 12 |
| 7 | Er | 70 | 1250 | 0.22 | 4.8 | 13 |
| 8 | Tm | 70 | 1275 | 0.25 | 4.7 | 13 |
| 9* | Sm | 70 | 1200 | 0.2 | 4.2 | 8 |
| 10* | Yb | 70 | Not semiconductorized | — | — | — |
| 11* | Lu | 70 | Not semiconductorized | — | — | — |

*Out of the range of the present invention.

As apparent from Table 1, according to Sample No. 9, it was found that since the semiconductor dopant was a conventionally used Sm, although the rate ΔR of resistance change was 4 digits or more, that is, 4.2 digits, the rising coefficient α was decreased to 8%/° C.

In addition, according to Sample Nos. 10 and 11, it was found that as the semiconductor dopant, although Yb and Lu, which belonged to the same rare earth group as that of the present invention, were used, semiconductorization could not be performed at a firing temperature in the range of 1,150 to 1,275° C.

On the other hand, according to Sample Nos. 1 to 8, 0.2 molar parts of the semiconductor dopant of the present invention was contained with respect to 100 molar parts of Ti, a sufficiently high rate ΔR of resistance change of 4.2 to 4.5 digits could be obtained, and the rising coefficient α was also 9 to 13%/° C., which was 9%/° C. or more; hence, it was found that a multilayer positive temperature coefficient thermistor simultaneously having superior rate ΔR of resistance change and rising coefficient α could be obtained.

In addition, according to Sample No. 9 (conventional technique) using Sm as the semiconductor dopant, the optimum firing temperature was 1,200° C., and according to Sample Nos. 1 to 8 in which the semiconductor dopant of the present invention was used, the optimum temperature was high, such as 1,225 to 1,275° C. Hence, it was confirmed that even when the firing temperature was high as compared to that of the conventional technique, a semiconductor ceramic layer having a sintered density of 70% could be obtained.

According to the results described above, it was found that in order to simultaneously realize superior rate ΔR of resistance change and rising coefficient α, the specific semiconductor dopant described in the present invention was very effectively contained in the semiconductor ceramic layer.

Example 2

As the starting materials, $BaTiO_3$, $TiO_2$, and $Er_2O_3$, which was used as the semiconductor dopant, were prepared, and these starting materials were weighed so as to obtain a semiconductor ceramic layer having a composition of $(Ba_{1-p}Er_p)\times(Ti_{1-q}Er_q)_yO_3$ (where px+qy=u, $0.996 \leqq x/y \leqq 1.008$, and $0.0005 \leqq u \leqq 0.01$ were satisfied), and subsequently, by using a method and a procedure similar to those of [Example 1], multilayer positive temperature coefficient thermistors of Sample Nos. 21 to 34 were formed. In this example, the firing treatments in a reducing atmosphere were all performed at 1,250° C.

Next, after 20 samples of each of Sample Nos. 21 to 34 were prepared, by methods similar to those of [Example 1], the room-temperature resistance X, the rate ΔR of resistance change, and the rising coefficient of resistance a were obtained.

Table 2 shows the Er content and the ratio x/y of the Ba site to the Ti site of each sample, and also shows the average values, which were obtained from the respective 20 samples, of the room-temperature resistance X, the rate ΔR of resistance change, and the rising coefficient of resistance α.

TABLE 2

| | $(Ba_{1-p}Er_p)_x(Ti_{1-q}Er_q)_yO_3$: px + qy = u | | | | |
|---|---|---|---|---|---|
| Sample No. | u | x/y | Room-Temperature Resistance X (Ω) | Rate ΔR of Resistance change (Number of Digits) | Rising coefficient α (%/° C.) |
| 21* | 0.0005 | 1.000 | 2.37 | 2.8 | 12.6 |
| 22 | 0.001 | 1.000 | 0.29 | 5.6 | 15.6 |
| 23 | 0.0015 | 1.000 | 0.25 | 5.6 | 13.5 |
| 24 | 0.002 | 1.000 | 0.22 | 4.8 | 13 |
| 25 | 0.003 | 1.000 | 0.21 | 4.4 | 11 |
| 26 | 0.005 | 1.000 | 0.18 | 4 | 9 |
| 27* | 0.01 | 1.000 | 1.48 | 2.8 | 4 |
| 28* | 0.002 | 0.996 | 0.31 | 4 | 7 |
| 29 | 0.002 | 0.998 | 0.25 | 4.3 | 9 |
| 30 | 0.002 | 1.000 | 0.22 | 4.8 | 13 |
| 31 | 0.002 | 1.002 | 0.22 | 4.8 | 13 |
| 32 | 0.002 | 1.004 | 0.23 | 4.9 | 14 |
| 33 | 0.002 | 1.006 | 0.3 | 5.1 | 15 |
| 34* | 0.002 | 1.008 | 0.52 | — | — |

*Out of the range of the present invention.

In Sample Nos. 21 to 27, the ratio x/y of the Ba site to the Ti site was set constant at 1.000, and the content of Er was changed.

According to Sample No. 21, since the content of Er was 0.05 molar parts with respect to 100 molar parts of Ti, which was less than 0.1 molar parts, semiconductorization could not be sufficiently performed; hence, as a result, the rate ΔR of resistance change was low, such as 2.8 digits, and the room-temperature resistance X was increased to 2.37Ω.

In addition, according to Sample No. 27, it was found that since the content of Er was 1 molar part with respect to 100 molar parts of Ti, which was more than 0.5 molar parts, the rate ΔR of resistance change was low, such as 2.8 digits, the rising coefficient α was also low, such as 4%/° C., and the room-temperature resistance X was increased to 1.48Ω.

On the other hand, according to Sample Nos. 22 to 26, it was found that since the content of Er was within the range of 0.1 to 0.5 molar parts with respect to 100 molar parts of Ti, superior results were obtained such that the rate ΔR of resistance change was 4 digits or more, the rising coefficient α was 9%/° C. or more, and furthermore the room-temperature resistance X was decreased to 0.3Ω or less. In particular, according to Sample Nos. 22 to 25 in which the content of Er with respect to 100 molar parts of Ti was in the range of 0.1 to 0.3 molar parts, it was found that since the rate ΔR of resistance change was 4.4 digits or more, and the rising coefficient α was 10%/° C. or more, more superior results could be obtained.

In addition, in Sample Nos. 28 to 34, the content of Er was maintained constant at 0.2 molar parts with respect to 100 molar parts of Ti, and the ratio x/y of the Ba site to the Ti site was changed.

According to Sample No. 28, since the ratio x/y of the Ba site to the Ti site was 0.996, which was less than 0.998, the rising coefficient α was decreased to 7%/° C.

In addition, according to Sample No. 34, since the ratio x/y of the Ba site to the Ti site was 1.008, which was more than 1.006, the properties were unstable, and both the rising coefficient α and the rate ΔR of resistance change could not be precisely measured.

On the other hand, according to Sample Nos. 29 to 33, it was found that since the ratio x/y of the Ba site to the Ti site was in the range of 0.998 to 1.006, which was within the range of the present invention, the rate ΔR of resistance change was 4 digits or more, and the rising coefficient α was 9%/° C. or more. In particular, according to Sample Nos. 30 to 33 in which the ratio x/y of the Ba site to the Ti site was in the range of 1.000 to 1.006, the rate ΔR of resistance change was 4.8 digits or more, and the rising coefficient α was steep, such as 13%/° C. or more; hence, it was found that the rate ΔR of resistance change and the rising coefficient α were both significantly improved.

Example 3

As the starting materials, $BaTiO_3$, $TiO_2$, and $Er_2O_3$, which was used as the semiconductor dopant, were prepared, and these starting materials were weighed so as to obtain a semiconductor ceramic layer having a composition of $(Ba_{0.998}Er_{0.002-v})(TiEr_v)O_3$, and subsequently, by using a method and a procedure similar to those of [Example 1], a calcined powder was obtained.

Next, an acrylic acid-based organic binder, an ammonium polycarboxylate salt (dispersant), and pure water were added to the above calcined powder and were then mixed in a ball mill with PSZ balls for 15 hours, so that a ceramic slurry was obtained. In this example, the addition amount of the acrylic acid-based organic binder was adjusted so that the actual-measured sintered density after firing was 60% to 95% of the theoretical sintered density.

Subsequently, multilayer positive temperature coefficient thermistors of Sample Nos. 41 to 48 were formed by using a method and a procedure similar to those of [Example 1]. In this example, the firing treatments in a reducing atmosphere were all performed at 1,250° C.

Next, 20 multilayer positive temperature coefficient thermistors of each of Sample Nos. 41 to 48 were prepared, and by methods similar to those of [Example 1], the room-temperature resistance X, the rate ΔR of resistance change, and the rising coefficient α were measured.

Table 3 shows the sintered density (relative ratio of the actual-measured sintered density to the theoretical sintered density), and the average values, which were obtained from the respective 20 samples, of the room-temperature resistance X, the rate ΔR of resistance change, and the rising coefficient of resistance α.

TABLE 3

| | $(Ba_{0.998}A_{0.002-v})(TiEr_v)O_3$ | | | |
|---|---|---|---|---|
| Sample No. | Sintered Density (%) | Room-Temperature Resistance X (Ω) | Rate ΔR of Resistance change (Number of Digits) | Rising coefficient α (%/° C.) |
| 41* | 60 | Not semiconductorized | — | — |
| 42 | 65 | 0.25 | 5.2 | 13 |
| 43 | 70 | 0.22 | 4.8 | 13 |
| 44 | 75 | 0.22 | 4.6 | 12 |
| 45 | 80 | 0.2 | 4.6 | 11 |
| 46 | 85 | 0.18 | 4.0 | 10 |
| 47 | 90 | 0.12 | 4.0 | 10 |
| 48* | 95 | 0.08 | — | — |

*Out of the range of the present invention.

As apparent from Table 3, according to Sample No. 41, since the sintered density was too low, such as 60%, semiconductorization could not be sufficiently performed.

In addition, according to Sample No. 48, since the sintered density was high, such as 95%, oxygen in the re-oxidation treatment was not diffused sufficiently to the central portion, so that oxidation irregularities were generated; hence, as a result, the rate ΔR of resistance change and the rising coefficient α could not be precisely measured.

On the other hand, according to Sample Nos. 42 to 47, since the sintered density was in the range of 65% to 90%, the rate ΔR of resistance change was in the range of 4.0 to 5.2 digits, which was 4 digits or more, and the rising coefficient α was in the range of 10 to 13%/° C., which was 9%/° C. or more; hence, it was found that superior rate ΔR of resistance change and rising coefficient α could be simultaneously obtained.

Example 4

In this example, by using the ratio t/D of the thickness t of the diffusion layer formed by diffusion from the internal electrode layer to the thickness D of the semiconductor ceramic layer as a parameter, properties of the multilayer positive temperature coefficient thermistor were evaluated.

That is, first, as the starting materials, $BaTiO_3$, $TiO_2$, $Er_2O_3$ and $Sm_2O_3$, the latter two being used as the semiconductor dopant, were prepared, and these starting materials were weighed so as to obtain a semiconductor ceramic layer having a composition of $(Ba_{0.998}A_{0.002-v})(TiA_v)O_3$ (where A indicated Er or Sm). Subsequently, by using a method and a procedure similar to those of [Example 1], multilayer positive temperature coefficient thermistors of Sample Nos. 51 to 61 were formed.

In this example, the firing treatment in a reducing atmosphere was performed at a firing temperature of 1,250° C., the ratio t/D of the thickness t of the diffusion layer to the thickness D of the semiconductor ceramic layer was adjusted by changing the thickness of the ceramic green sheet, and the ratio t/D was obtained from the thickness t of the diffusion layer and the thickness D of the semiconductor ceramic layer by observing each sample using a TEM (transmission electron microscope). In addition, the thicknesses D of the semiconductor ceramic layers of Sample Nos. 57 and 59 were both set to 10 μm.

Next, 10 multilayer positive temperature coefficient thermistors of each of Sample Nos. 51 to 59 were prepared, and by methods similar to those of [Example 1], the room-temperature resistance X, the rate ΔR of resistance change, and the rising coefficient α were obtained.

Table 4 shows the types of semiconductor dopants and the average values of the ratio t/D of the thickness t of the diffusion layer to the thickness D of the semiconductor ceramic layer, the room-temperature resistance X, the rate ΔR of resistance change, and the rising coefficient of resistance a of Sample Nos. 51 to 59.

TABLE 4

| | $(Ba_{0.998}A_{0.002-v})(TiA_v)O_3$ | | | | |
|---|---|---|---|---|---|
| Sample No. | A | t/D (-) | Room-Temperature Resistance X (Ω) | Rate ΔR of Resistance change (Number of Digits) | Rising coefficient α (%/° C.) |
| 51** | Er | 0.008 | 0.39 | 3.9 | 10 |
| 52 | Er | 0.01 | 0.20 | 4.9 | 13 |
| 53 | Er | 0.05 | 0.20 | 4.8 | 13 |
| 54 | Er | 0.08 | 0.20 | 4.8 | 13 |
| 55 | Er | 0.10 | 0.22 | 4.8 | 13 |
| 56 | Er | 0.13 | 0.22 | 4.8 | 13 |
| 57 | Er | 0.20 | 0.27 | 4.5 | 11 |
| 58** | Er | 0.29 | 0.36 | 3.9 | 7 |
| 59* | Sm | 0.25 | 0.31 | 3.8 | 7 |

*Out of the range of the present invention.
**Out of the range of the present invention (Claim 2).

As apparent from Table 4, according to Sample No. 59, it was found that since Sm, which was out of the range of the present invention, was used as the semiconductor dopant, the rising coefficient α was decreased to 7%/° C. In addition, according to Sample Nos. 57 and 59, since the thickness D of the semiconductor ceramic layer was 10 μm as described above, the thickness of the diffusion layer of each sample described above was confirmed at a plurality of points. As a result, it was found that the degree of diffusion of Sample No. 59 was approximately 1.25 times that of Sample No. 57.

From the results described above, it was found that since Sm was used as the semiconductor dopant in Sample No. 59, which was different from that in Sample No. 57, Ni was excessively diffused from the internal electrode layer into the semiconductor ceramic layer, and thereby the ratio of the thickness t of the diffusion layer to the thickness D of the semiconductor ceramic layer was inevitably increased. Hence, as a result, it was believed that the rising coefficient α was decreased.

According to Sample No. 51, since the ratio t/D was 0.008, which was less than 0.01, the rising coefficient α was superior, such as 10%/° C. However, the rate ΔR of resistance change varied, the average value thereof was decreased to 3.9 digits, which was less than 4 digits, and the room-temperature resistance was also increased to 0.39Ω; hence, it was found that the results of Sample No. 51 were not preferable.

In addition, according to Sample No. 58, since the ratio t/D was 0.29, which was more than 0.20, the rising coefficient α was decreased to 7%/° C., and the rate of resistance change was also decreased to less than 4 digits; hence, it was found that the results of Sample No. 58 were not preferable.

On the other hand, according to Sample Nos. 52 to 57, since the ratio t/D was in the range of 0.01 to 0.20, the rate ΔR of resistance change was in the range of 4.5 to 4.9 digits, and hence, superior results could be obtained. Furthermore, it was also found that a superior rising coefficient α of 11 to 13%/° C. could be obtained.

In addition, since the amount of Ni diffused from the internal electrode layer to the semiconductor ceramic layer can be decreased according to the present invention, the thickness t of the diffusion layer of Sample Nos. 52 to 57 can be decreased. And as a result, it was confirmed that while superior rate ΔR of resistance change and rising coefficient α are maintained, a multilayer positive temperature coefficient thermistor having an even further reduced thickness can be obtained.

The invention claimed is:

1. A multilayer positive temperature coefficient thermistor comprising:

a ceramic body in which semiconductor ceramic layers having a sintered density in the range of 65% to 90% of a theoretical sintered density and internal electrode layers are alternately laminated to each other;

diffusion layers between the semiconductor ceramic layers and the internal electrode layers; and external electrodes formed on two end portions of the ceramic body and electrically connected to the internal electrode layers, wherein a $BaTiO_3$-based ceramic material is a primary component in the semiconductor ceramic layers, the ratio of the Ba site to the Ti site of the $BaTiO_3$-based ceramic material is represented by 0.998≦Ba site/Ti site≦1.006, at least one element selected from the group consisting of Eu, Gd, Tb, Dy, Y, Ho, Er, and Tm is contained in the semiconductor ceramic layers as a semiconductor dopant in the range of 0.1 to 0.5 molar parts with respect to 100 molar parts of Ti, the internal electrode layers include Ni as a primary component, and a ratio of a thickness t of the diffusion layers and a thickness D of the semiconductor ceramic layers is represented by 0.01≦t/D≦0.20.

2. The multilayer positive temperature coefficient thermistor according to claim 1, wherein the semiconductor ceramic layers have an actual-measured sintered density in the range of 65% to 90% of the theoretical sintered density.

3. The multilayer positive temperature coefficient thermistor according to claim 1, wherein the diffusion layers primarily contain Ni.

4. The multilayer positive temperature coefficient thermistor according to claim 3, wherein the Ni in the diffusion layers is diffused from the internal electrode layers into the semiconductor ceramic layers.

5. A multilayer positive temperature coefficient thermistor comprising:

a ceramic body in which semiconductor ceramic layers and internal electrode layers are alternately laminated to each other;

diffusion layers between the semiconductor ceramic layers and the internal electrode layers; and external electrodes formed on the ceramic body and electrically connected to the internal electrode layers, wherein a $BaTiO_3$-based ceramic material is a primary component in the semiconductor ceramic layers, the ratio of the Ba site to the Ti site of the $BaTiO_3$-based ceramic material is represented by 0.998≦Ba site/Ti site≦1.006, the semiconductor layers contain a semiconductor dopant in the range of 0.1 to 0.5 molar parts with respect to 100 molar parts of Ti, the internal electrode layers include Ni as a primary component, and a ratio of a thickness t of the diffusion layers and a thickness D of the semiconductor ceramic layers is represented by 0.01≦t/D≦0.20.

6. The multilayer positive temperature coefficient thermistor according to claim 5, wherein the semiconductor ceramic layers have an actual-measured sintered density in the range of 65% to 90% of the theoretical sintered density.

7. The multilayer positive temperature coefficient thermistor according to claim 5, wherein the semiconductor dopant is at least one element selected from the group consisting of Eu, Gd, Tb, Dy, Y, Ho, Er, and Tm.

8. The multilayer positive temperature coefficient thermistor according to claim 5, wherein the diffusion layers primarily contain Ni.

9. The multilayer positive temperature coefficient thermistor according to claim 8, wherein the Ni in the diffusion layers is diffused from the internal electrode layers into the semiconductor ceramic layers.

* * * * *